US009013361B1

(12) United States Patent
Lam

(10) Patent No.: US 9,013,361 B1
(45) Date of Patent: Apr. 21, 2015

(54) INTERLOCKING SUBARRAY CONFIGURATIONS

(71) Applicant: Lockheed Martin Corporation, Bethesda, MD (US)

(72) Inventor: Lawrence K. Lam, San Jose, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 247 days.

(21) Appl. No.: 13/720,948

(22) Filed: Dec. 19, 2012

Related U.S. Application Data

(60) Provisional application No. 61/577,589, filed on Dec. 19, 2011.

(51) Int. Cl.
*H01Q 21/06* (2006.01)
*H01P 11/00* (2006.01)

(52) U.S. Cl.
CPC ..... *H01Q 21/061* (2013.01); *H01P 11/00* (2013.01)

(58) Field of Classification Search
USPC ..... 343/824, 893; 342/368, 372, 373
See application file for complete search history.

(56) References Cited

U.S. PATENT DOCUMENTS

| | | | | |
|---|---|---|---|---|
| 3,938,160 | A | 2/1976 | Mailloux et al. | |
| 4,257,050 | A | 3/1981 | Ploussios | |
| 4,332,018 | A | 5/1982 | Sternberg et al. | |
| 5,923,289 | A * | 7/1999 | Buer et al. | 342/373 |
| 6,559,797 | B1 * | 5/2003 | Chang | 342/368 |
| 7,081,851 | B1 * | 7/2006 | Lewis | 342/372 |
| 7,474,262 | B2 * | 1/2009 | Alland | 342/371 |
| 8,077,109 | B1 * | 12/2011 | Roberts et al. | 343/824 |
| 8,344,945 | B2 * | 1/2013 | Craig et al. | 342/354 |

OTHER PUBLICATIONS

Mailloux, et al., "Parameter variation with Array Size for Broadband Arrays of Irregular Polyomino Subarrays," 2007 IEEE pp. 129-132.

* cited by examiner

*Primary Examiner* — Hoang V Nguyen
(74) *Attorney, Agent, or Firm* — McDermott Will & Emery LLP

(57) ABSTRACT

A method of forming overlapping antenna subarrays includes forming one or more first-level subarrays by combing multiple elements. Each first-level subarray may have a phase center. One or more second-level subarrays may be formed by arranging a number of the first-level subarrays to form each first-level subarray. One or more third-level subarrays may be formed by arranging a number of the second-level subarrays to form each second-level subarray. The first-level, second-level, and third-level subarrays may include overlapping antenna subarrays. Each element may include an antenna element. Some of the first level, second-level, or third level subarrays may have an interlocking feature that allows interlocking of each subarray with another one of the same subarray. Arranging subarrays may include interlocking subarrays.

20 Claims, 11 Drawing Sheets

(FIFTH LEVEL)

(SECOND LEVEL)

(THIRD LEVEL)

(THIRD LEVEL)

(FOURTH LEVEL)

(FIFTH LEVEL)

Primary scan in the azimuth direction
232
200
205
110
100
(SECOND LEVEL)

230
220
220
(FIFTH LEVEL)

210
210
210
210
220
(FOURTH LEVEL)

200
200
200
200
210
(THIRD LEVEL)

(FIRST LEVEL)

(FIRST LEVEL)

(SECOND LEVEL)

(SECOND LEVEL)

(SQUARE ANTENNA ARRAY)

(THIRD LEVEL)

(THIRD LEVEL)

(THIRD LEVEL)

INTERLOCKING SUBARRAY CONFIGURATIONS

CROSS-REFERENCE TO RELATED APPLICATIONS

This application claims the benefit of priority under 35 U.S.C. §119 from U.S. Provisional Patent Application 61/577,589 filed Dec. 19, 2011, which is incorporated herein by reference in its entirety.

STATEMENT REGARDING FEDERALLY SPONSORED RESEARCH OR DEVELOPMENT

Not applicable.

FIELD OF THE INVENTION

The present invention generally relates to phased array antennas, and more particularly, to interlocking subarray configurations.

BACKGROUND

Conventional array antennas that supports wide angle electronically steered scans may require antenna radiating element spacing of approximately one-half wavelength. This may result in implementations that use a large number of independent antenna radiating elements. Generally, there can be a number of components associated with each antenna radiating element. For example, the components may include active components such as low noise amplifier (LNA) and transmit power amplifiers, and passive components such as filters and other components including phase shifters and amplitude control circuits. As the number of beams to be formed increases, the number of part counts may increase proportionally. One of the objectives in many array designs is to reduce the number of components per element, while providing larger number of electronically scanned beams. Multiple beams may be provided within a given scan volume, which is defined by the size of the smallest subarray or the basic building blocks for the array.

SUMMARY

In some aspects, a method of forming overlapping antenna subarrays includes forming one or more first-level subarrays by combing multiple elements. Each first-level subarray may have a phase center. One or more second-level subarrays may be formed by arranging a number of the first-level subarrays to form each second-level subarray. One or more third-level subarrays may be formed by arranging a number of the second-level subarrays to form each third-level subarray. The first-level, second-level, and third-level subarrays may include overlapping antenna subarrays. Each element of the multiple elements may include an antenna element. Some of the first level, second-level, or third level subarrays may have an interlocking feature that allows interlocking of each subarray with another one of the same subarray. Arranging subarrays may include interlocking subarrays.

In another aspect, an apparatus may include one or more first-level subarrays, each having a phase center and including multiple elements. One or more second-level subarrays may be formed by arranging a number of the first-level subarrays. One or more third-level subarrays may be formed by arranging a number of the second-level subarrays to form each third-level subarray. The first-level, second-level, and third-level subarrays may include overlapping antenna subarrays. Each element of the multiple elements may include an antenna element. Some of the first level, second-level, or third level subarrays may have interlocking features configured to allow interlocking of each subarray with another one of the same subarray. Arranging subarrays may include interlocking subarrays.

In yet another aspect, an antenna array may include one or more first-level subarrays. Each first-level subarray may include multiple antenna elements, my have a phase center, and may be configured to function with a single beam-steering electronic module. One or more second-level subarrays may be formed by arranging a number of the first-level subarrays to form each second-level subarray. One or more third-level subarrays may be formed by arranging a number of the second-level subarrays to form each third-level subarray. The first-level, second-level, and third-level subarrays may include overlapping antenna subarrays having interlocking features configured to allow interlocking of each subarray with another one of the same subarray. Arranging subarrays may include interlocking subarrays. The antenna array may be formed by interlocking a plurality of the third-level subarrays and may be configured to radiate with a radiation pattern.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

The present disclosure is generally directed to phased array antennas, and in particular to the architecture and configuration used for implementing array antennas with limited scan. In an aspect of the present technology, overlapping subarrays, with the overlapping circuits implemented using RF interconnects are provided. The subject technology may provide a suitable amount of overlapping between subarrays. The overlap is provided by using subarray configurations including interlocking features. This provides the benefit of simplifying the design of interconnects, which can reduce front-end interconnects and leading to lower weight and cost. The benefits may also include delivering one or more beams with acceptable antenna gain and beam pattern performance. The subarray configurations described here may provide choice of designs to be made to suit applications where higher priority is given to lower cost and lower weight at the expense of reducing the size of scan volume.

In an aspect, overlapping subarrays may be used with the overlapping circuits implemented using RF interconnects. This may lead to reduced number of components, while scanning beams in a limited sector scan volume. The subject technology may provide a suitable amount of overlapping between subarrays. The overlaps may be provided by using subarray configurations having interlocking features. This provides the benefit of reduced interconnects and lower cost.

Figure 1A:
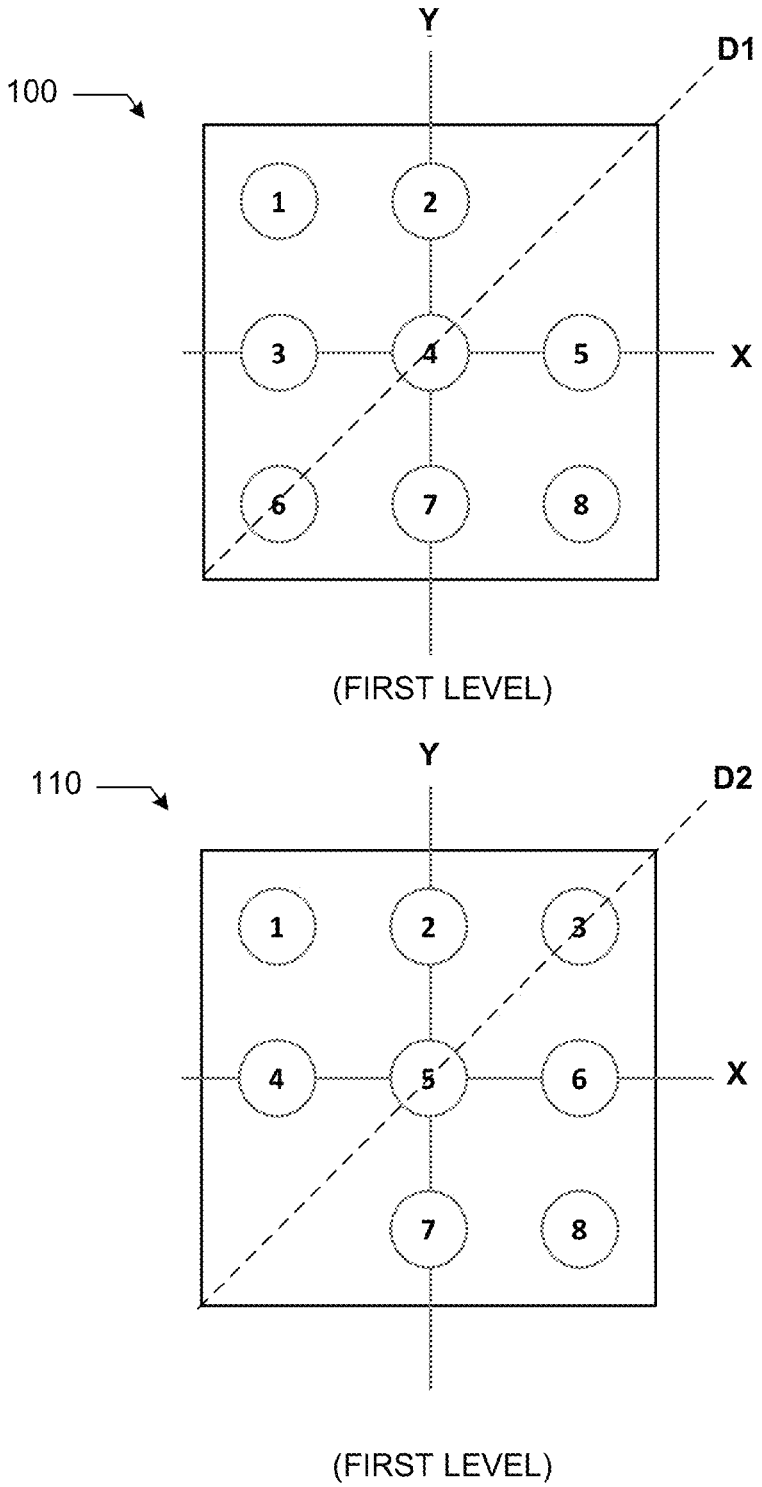
FIG. 1A is a diagram illustrating example first-level subarrays, according to certain embodiments.

FIG. 1A is a diagram illustrating example first-level subarrays 100 and 110, according to certain embodiments. The first-level subarray 100 includes a number of (e.g., eight) elements (e.g., radiating elements, such as antenna elements, ultrasonic or audio transducers, etc.) labeled with element numbers (e.g., 1 to 8). The radiating elements may be aligned to a rectangular lattice along x and y axes. One of the spots (e.g., the upper right corner spot) of the first-level subarray 100 does not contain a radiating element. The first-level subarray 100 may be identified as a first type first-level subarray. The first-level subarray 110 may be identified as a second type first-level subarray, for which the empty spot is on a lower left corner spot. In other words, the empty spot on the first and the second type first-level subarrays 100 and 110 are positioned on opposite sides of symmetry axes D1 and D2 of the first-level subarrays 100 and 110. The empty spots on the first-level subarrays 100 and 110 may provide the interlocking feature of the subarrays.

In the first-level subarrays 100 and 110, which are implemented by using eight radiating elements, the choice of the number of radiating elements (e.g., eight) may be a practical consideration; because a subarray comprising four elements may be too small and a subarray comprising 16 elements may lead to more complex interconnects. It is understood that implementing beam forming networks with subarrays having a number of radiating elements equal to a power of two (e.g., $2^3=8$) may be relatively simple and efficient. The size of the radiating elements may be determined based on the radiation frequency of the elements. For example, in RF applications, the center-to-center distance of the radiating elements may be chosen to be nearly $\lambda/2$, where $\lambda$ is the wavelength corresponding to the radiation frequency of the elements.

The radiating elements of the first-level subarrays (e.g., 100 and 110) may share a single beam-steering electronic module. Each radiating element of the first-level subarrays may be implemented on a single chip or a small circuit board. In some aspects, the radiating elements of the first-level subarrays may be integrated with the beam-steering electronic module (e.g., including logic, circuitry, and/or code) on a single circuit board. Each first-level subarray may define a center element to be a phase center (e.g., element 4 of first-level subarray 100 and element 5 of first-level subarray 110). The phase center may be an electrical center of the subarray. The position of the phase center of the subarray (e.g., the first-level subarray) may be controlled, by control electronics (e.g., including logic, circuitry, and/or code), to be positioned on a radiating element located near the center of the subarray. The control electronics may use the phase center (e.g., phase center element) as a reference point and delay signals associated with other radiating elements relative to the phase center element. The phase center of a subarray, at a far distance from the subarray, may be viewed as a point that the signals radiated by the subarray are originating from.

Figure 1B:
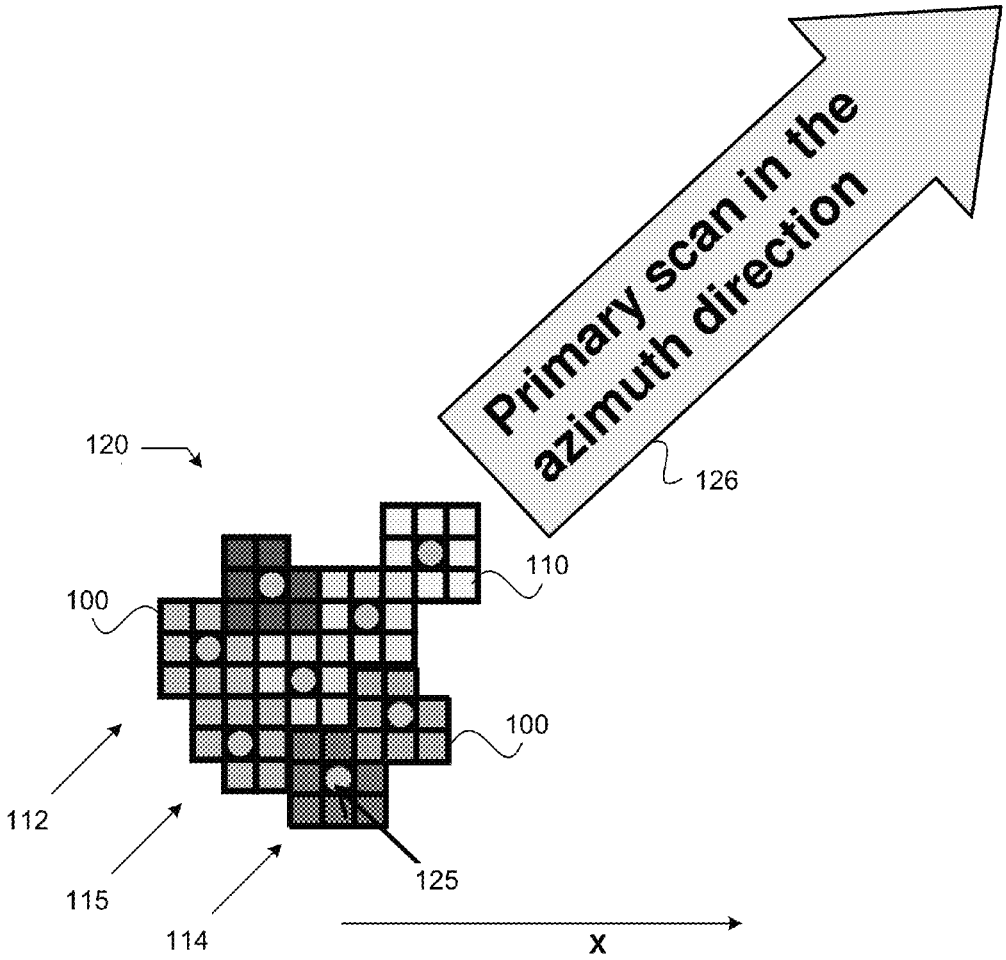
FIG. 1B is a diagram illustrating an example second-level subarray formed by interlocking the first-level subarrays of FIG. 1A, according to certain embodiments.

FIG. 1B is a diagram illustrating an example second-level subarray 120 formed by interlocking the first-level subarrays 100 and 110 of FIG. 1A, according to certain embodiments. The second-level subarray 120 may be formed by arranging (e.g., interlocking) a number of first-level subarrays (e.g., first-level subarrays 100 and 110 of FIG. 1A). In one or more aspects, the second-level subarray 120 may be formed by interlocking four subarray 110 to form a subarray 115, which is interlocked with two subarrays 112 and 114. The subarray 115 may be formed by interlocking lower level subarrays along a first axis (e.g., a primary axis). The lower level subarrays may include a first set of the second type first-level subarrays 110. On each side of the subarray 115, a subarray 112 or 114 formed by a second set of the first-type first-level subarrays 100 may be interlocked on a second axis parallel to the first axis. The first set may include four second-type first-level subarrays 110, and the second set may include three first type first-level subarrays 100. The first axis may be the radiation axis of the second-level subarray 120.

The second-level subarray 120 may have special characteristics that the individual radiating elements are aligned along a rectangular lattice. The phase centers 125 of the interlocked first-level subarrays (e.g., 100 and 110) may have a symmetry axis at 45 degrees with the X axis, which coincides with the primary axis of the second-level subarray 120. The second-level subarray 120 may provide a scan in azimuth and elevation in the direction as indicated by the radiation axis 126, which extends along the diagonal of an aperture of the second-level subarray 120. Each of the first-level subarrays (e.g., 100 and 110) of eight radiating elements may be implemented by using a single beam-steering electronic module, instead of eight independent modules. Thus, the configuration of the design second-level subarray 120 may reduce component count by eight times, while providing the scan in the direction of the primary axis (e.g., the radiation axis 126) of the second-level subarray 120. The second-level subarray 120 may be integrated with the corresponding beam-steering electronic modules and control electronics on a printed circuit (PC) electronic board.

Figure 1C:
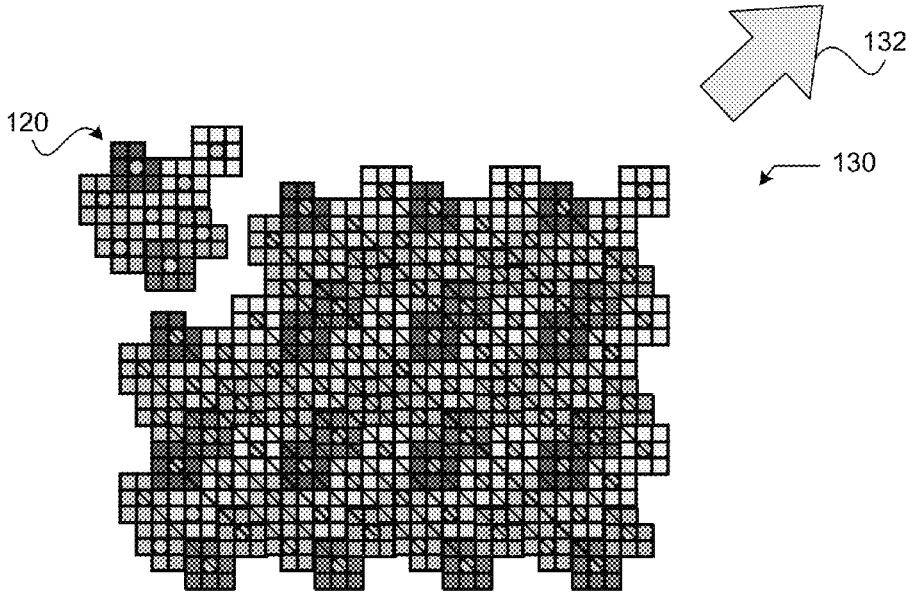
FIG. 1C is a diagram illustrating an example third-level subarray formed by interlocking the second-level subarrays of FIG. 1B, according to certain embodiments.

FIG. 1C is a diagram illustrating an example third-level subarray 130 formed by interlocking the second-level subarrays 120 of FIG. 1B, according to certain embodiments. The third-level subarray 130 includes a number (e.g., twelve) of the second-level subarrays 120 interlocked to form a rectangular subarray. The third-level subarray 130 may include a 4×3 array of the second-level subarrays 120. The arrangement of the second-level subarrays 120 may be such that the radiation axis of the interlocked second-level subarrays 120 are parallel to a diagonal of the rectangular third-level subarray 130, which forms the radiation axis 132 of the rectangular third-level subarray 130. The third-level subarray 130 has the interlocking feature, and can be used to form an antenna array by interlocking a multiple third-level subarrays 130. The third-level subarray 130 may be integrated with the corresponding beam-steering electronic modules and control electronics on an electronic board (e.g., a printed circuit (PC) board).

The third-level subarray 130 may have the special characteristic that the individual radiating elements can be aligned along a rectangular lattice. In one or more implementations, the phase centers of the interlocked second-level subarrays 120 may have a symmetry axis that is 45 degrees rotated from the primary symmetry axes of the basic rectangular lattice. The third-level subarray 130 may provide a scan in azimuth and elevation in the direction as indicated by the radiation axis 132 (e.g., along the diagonal of the aperture).

Figure 1D:
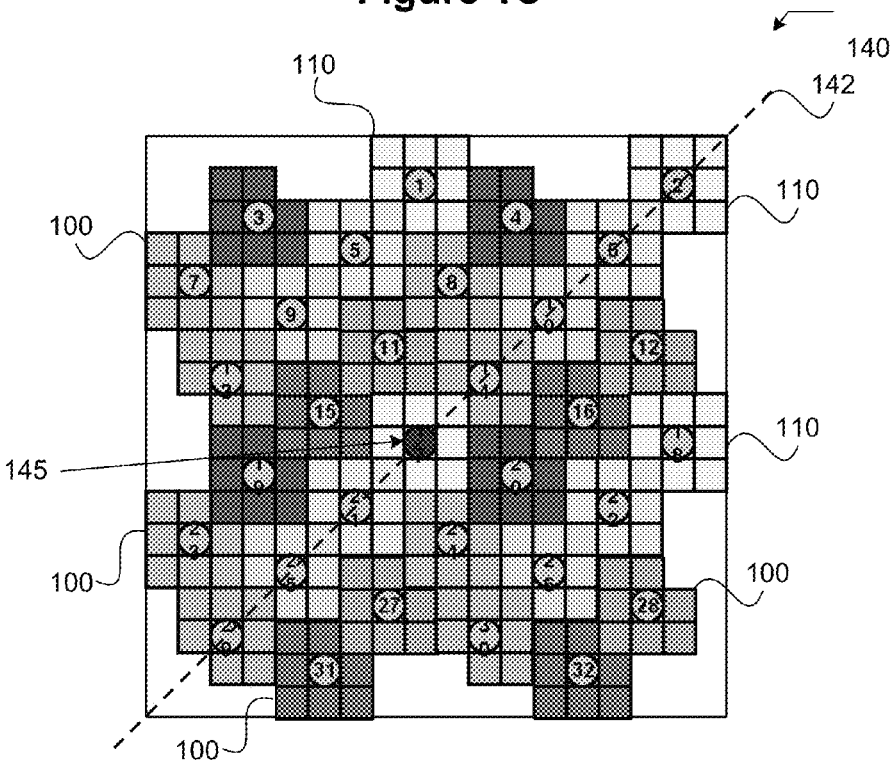
FIG. 1D is a diagram illustrating an example third-level subarray formed by interlocking the second-level subarrays of FIG. 1B, according to certain embodiments.

FIG. 1D is a diagram illustrating an example third-level subarray 140 formed by interlocking the second-level subarrays 120 of FIG. 1B, according to certain embodiments. The third-level subarray 140 may be formed by fitting a number of (e.g., four) second-level subarrays 120 in a square configuration. In one or more aspects, the third-level subarray 140 may be viewed as a square subarray formed by a number of (e.g., 32) first and second type first-level subarrays (e.g., 100 and 110 of FIG. 1A). The effective overlap between subarrays is the highest along a diagonal 142 of the square subarray, and the element 145 may be considered as the phase center of the third-level subarray 140. The radiation axis of the square subarray may be aligned with the diagonal 142 of the square subarray. The third-level subarray 140 may be integrated with the corresponding beam-steering electronic modules (e.g., 32 modules) and control electronics on an electronic board.

Figure 1E:
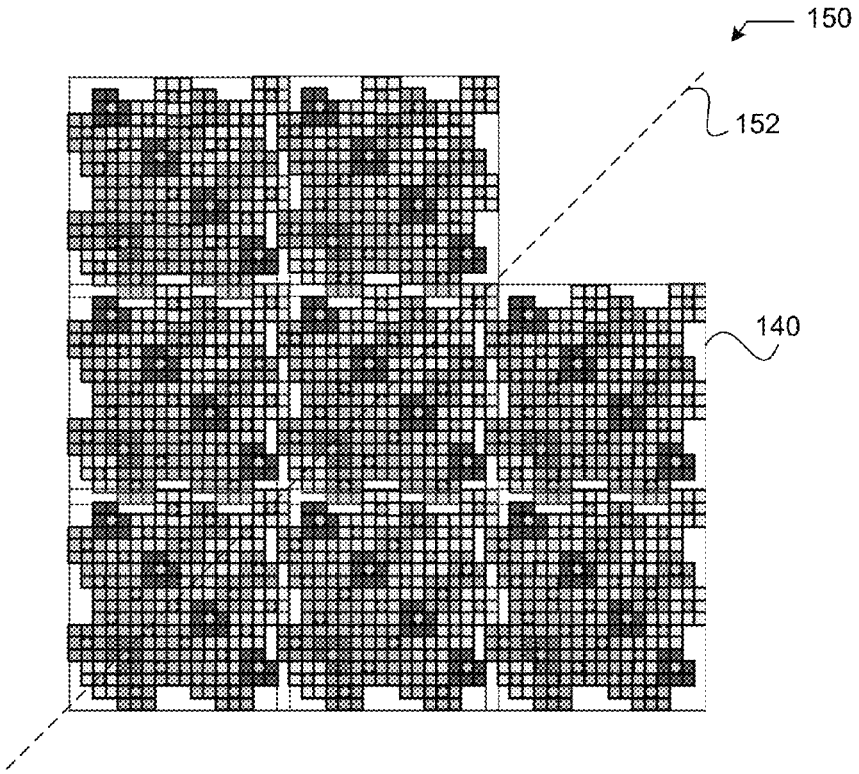
FIG. 1E is a diagram illustrating an example square aperture antenna array formed by interlocking the third-level subarrays of FIG. 1D, according to certain embodiments.

FIG. 1E is a diagram illustrating an example square-aperture antenna array (e.g., a fourth-level subarray) 150 formed by interlocking the third-level subarrays 140 of FIG. 1D, according to certain embodiments. The square-aperture antenna array 150 may be formed by interlocking a number (e.g., eight) of third-level subarrays 140 (e.g., square subarrays). The interlocking of the eight square subarrays may be performed, similar to formation of the first type or the second type first-level subarrays 100 and 110 of FIG. 1A, by fitting the eight third-level subarrays 140 in eight spots of a nine-cell square array (e.g., 3×3 configuration) leaving a corner spot empty. The square subarrays 140 in FIG. 1E are shown with small gaps in-between for illustration purposes. In practice the gaps may not exist and the square subarrays 140 may be fully interlocked. The axis of radiation 152 of the square-aperture antenna array 150 may be parallel to the axes of radiation of the individual square subarrays 140. The square-aperture antenna array 150 may be integrated with the corresponding beam-steering electronic modules (e.g., 32×8=256 modules) and control electronics as a single array antenna on one or more electronic boards.

Figure 1F:
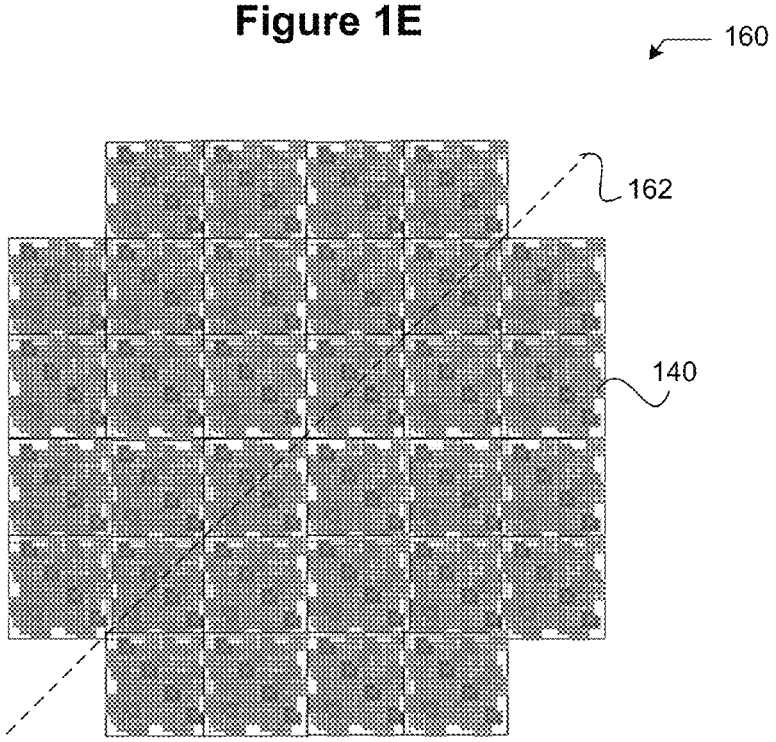
FIG. 1F is a diagram illustrating another example square aperture antenna array formed by interlocking the third-level subarrays of FIG. 1D, according to certain embodiments.

FIG. 1F is a diagram illustrating another example square aperture antenna array (e.g., a fourth-level subarray) 160 formed by interlocking the third-level subarrays 140 of FIG. 1D, according to certain embodiments. The square aperture antenna array 160 may be formed by interlocking 32 square subarrays 140 of FIG. 1D. The square subarrays 140 may be interlocked to fill cells of a 36-cell square array, excluding the corner cells. The axis of radiation 162 of the square-aperture antenna array 160 may be parallel to the axes of radiation of the individual square subarrays 140. The square subarrays 140 in the FIG. 1F are shown with small gaps in-between for illustration purposes. In practice the gaps may not exist and the square subarrays 140 may be fully interlocked. The square-aperture antenna array 160 may be integrated with the corresponding beam-steering electronic modules (e.g., 32×32=1024 modules) and control electronics as a single array antenna on one or more electronic boards.

Figures 2A, 2B, 2C, 2D:
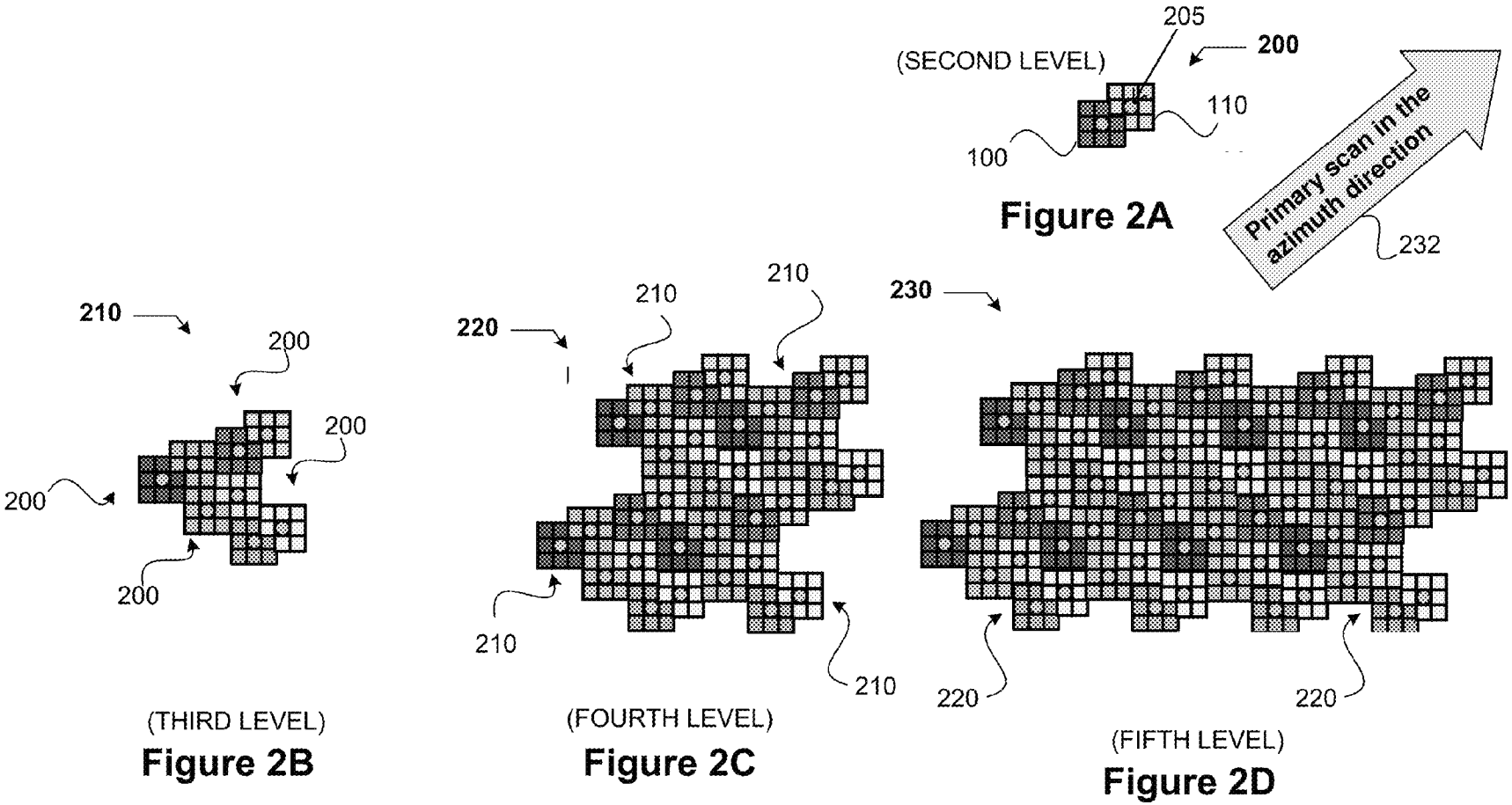
FIG. 2A is a diagram illustrating an example second-level subarray formed by interlocking the first-level subarrays of FIG. 1A, according to certain embodiments.
FIG. 2B is a diagram illustrating an example third-level subarray formed by interlocking the second-level subarrays of FIG. 2A, according to certain embodiments.
FIG. 2C is a diagram illustrating an example fourth-level subarray formed by interlocking the third-level subarrays of FIG. 2B, according to certain embodiments.
FIG. 2D is a diagram illustrating an example rectangular aperture antenna array formed by interlocking the fourth-level subarrays of FIG. 2C, according to certain embodiments.

FIG. 2A is a diagram illustrating an example second-level subarray 200 formed by interlocking the first-level subarrays 100 and 110 of FIG. 1A, according to certain embodiments. The second-level subarray 200 may be formed by interlocking a first-type and a second-type first-level subarray 100 and 110, and may form a building block for higher level subarrays. The phase centers 205 of the first-level subarrays 100 and 110 may line up to form a radiation axis for the second-level subarray 200.

FIG. 2B is a diagram illustrating an example third-level subarray 210 formed by interlocking the second-level subarrays 200 of FIG. 2A, according to certain embodiments. The third-level subarray 210 includes four of the second-level subarrays 200 interlocked to one another, such that the associated radiation axes of the second-level subarrays 200 are in-line or parallel with one another. The third-level subarray 210 may be used as a building block for forming higher level subarrays.

FIG. 2C is a diagram illustrating an example fourth-level subarray 220 formed by interlocking the third-level subarrays 210 of FIG. 2B, according to certain embodiments. The fourth-level subarray 220 may be formed by interlocking four of the third-level subarrays 210, such that the associated radiation axes of the second-level subarrays 200 of FIG. 2A, used as the building blocks of the third-level subarrays 210, are in-line or parallel with one another. The fourth-level subarray 220 may be used as a building block for forming higher level subarrays or antenna arrays.

FIG. 2D is a diagram illustrating an example rectangular aperture antenna array 230 formed by interlocking the fourth-level subarrays 220 of FIG. 2C, according to certain embodiments. The rectangular aperture antenna array 230 includes two of the fourth-level subarrays 220 interlocked to form a rectangular aperture antenna array. The rectangular aperture antenna array 230 may have a radiation axis 232 parallel to the radiation axis of the second-level subarrays 200 of FIG. 2A, used as the building blocks of the third-level subarrays 210. The rectangular aperture antenna array 230 may be integrated with the corresponding beam-steering electronic modules (e.g., 2×4×4×2=64 modules) and control electronics as a single array antenna on one or more electronic boards.

Figure 3A:
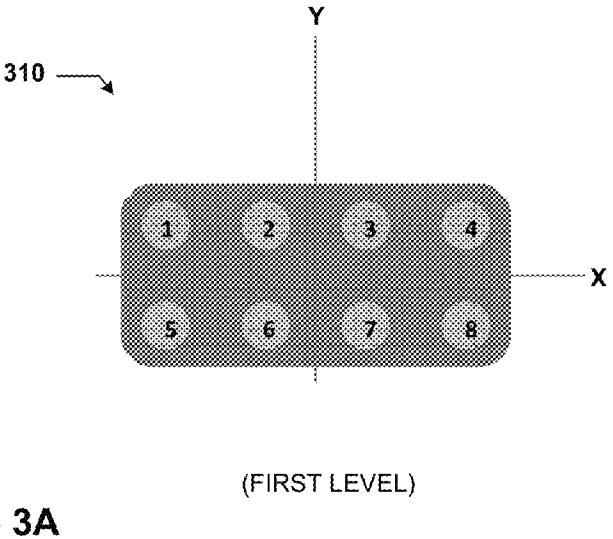
FIG. 3A is a diagram illustrating example first-level subarrays, according to certain embodiments.
Figure 3A:
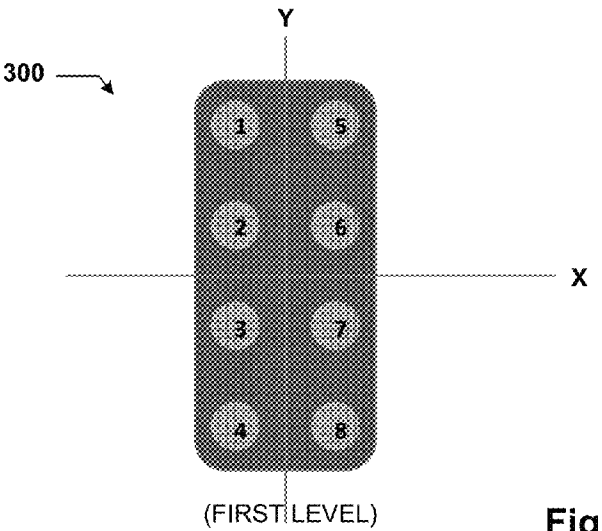

FIG. 3A is a diagram illustrating example first-level subarrays 300 and 310, according to certain embodiments. The first-level subarray 300 may be formed by arranging a number of (e.g., eight) elements to form a two-by-four cell vertical rectangular subarray. The first-level subarray 310 may be formed by arranging a number of (e.g., eight) elements to form a four-by-two cell horizontal rectangular subarray. The vertical and horizontal rectangular subarrays 300 and 310 include two axes of symmetry (e.g., X and Y axes). Each of the vertical and horizontal rectangular subarrays 300 and 310 may be built on a single chip or circuit board and may utilize a single beam-steering electronic module.

Figure 3B:
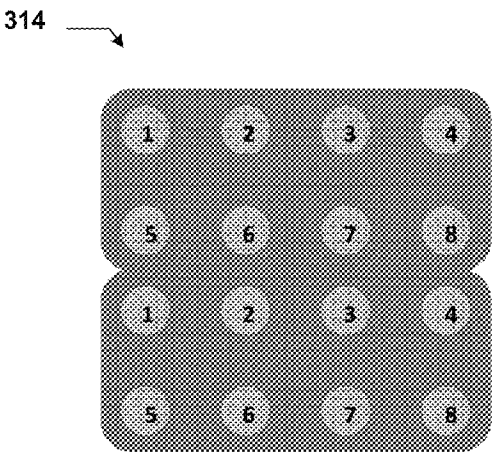
FIG. 3B is a diagram illustrating example second-level subarrays formed by interlocking the first-level subarrays of FIG. 3A, according to certain embodiments.
Figure 3B:
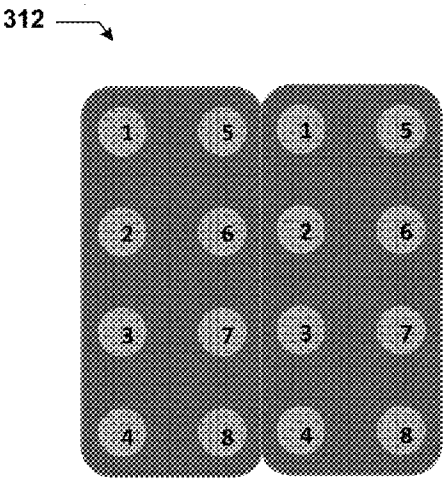

FIG. 3B is a diagram illustrating example second-level subarrays 312 and 314 formed by respectively interlocking the first-level subarrays 300 and 310 of FIG. 3A, according to certain embodiments. The second-level subarray 312 (e.g., a first-type second-level subarray) may be formed by arranging two first-level subarrays 300 in a horizontal (e.g., side-by-side) configuration. The second-level subarray 314 (e.g., a second type-type second-level subarray) may be formed by arranging two first-level subarrays 310 in a vertically stacked configuration.

Figure 3D:
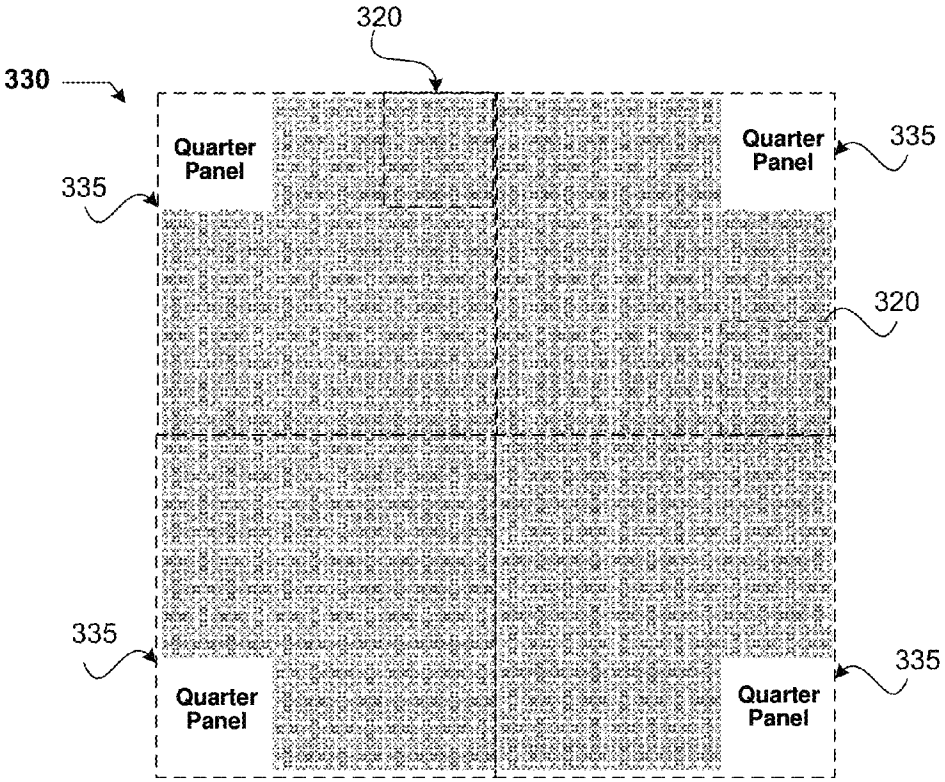
FIG. 3D is a diagram illustrating an example square antenna array formed by interlocking the third-level subarrays of FIG. 3C, according to certain embodiments.
Figure 3C:
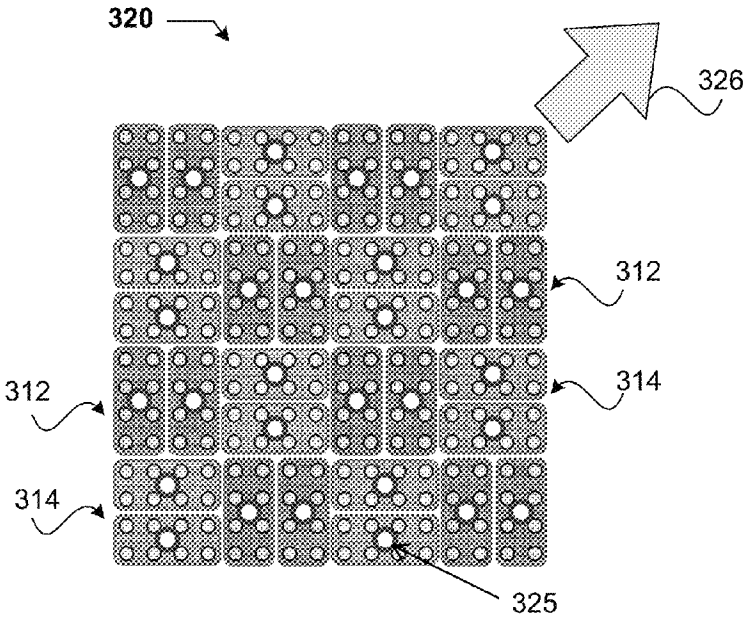
FIG. 3C is a diagram illustrating an example third-level subarray formed by interlocking the second-level subarrays of FIG. 3B, according to certain embodiments.

FIG. 3C is a diagram illustrating an example third-level subarray 320 formed by interlocking the second-level subarrays 312 and 314 of FIG. 3B, according to certain embodiments. The third-level subarray 320 may be formed by using the two types of second-level subarrays, the first-type second-level subarray 312 and the second-type second-level subarray 314. In the third-level subarray 320, eight first-type second-level subarray 312 and eight second-type second-level subarray 314 are set in an alternating configuration. The phase centers 325 of the individual vertical or horizontal rectangular subarrays 300 and 310 may have a more complex symmetry relative to that of the basic rectangular lattice (e.g., formed along X and Y axes of FIG. 3A). The third-level subarray 320 may reduce component counts by a factor of eight (each eight elements may use one beam-steering electronic module). The third-level subarray 320 may provide radiation directivity along the radiation axis 326, while allowing vertical scanning in the azimuthal angle associated with the radiation axis 326.

FIG. 3D is a diagram illustrating an example square antenna array 330 formed by interlocking the third-level subarrays 320 of FIG. 3C, according to certain embodiments. The square antenna array 330 may include 32 third-level subarrays 320 arranged to fill cells of a 36-cell square configuration, excluding the corner cells. The square antenna array 330 may also be viewed as being formed by fitting four fourth-level subarrays (e.g., quarter panels) 325, each including eight third-level subarrays 320 arranged to fill cells of a nine-cell square configuration, excluding a corner cell. The gaps between third-level subarrays 320 are shown for illustration purposes. These gaps may be minimized so that the individual radiating elements are approximately aligned to a rectangular lattice. The square antenna array 330 may provide radiation directivity along an axis parallel to the radiation axis 326 (of FIG. 3B) of each of the third-level subarrays 320, while allowing vertical scanning in an azimuthal angle associated with the radiation axis 326.

Figure 3E:
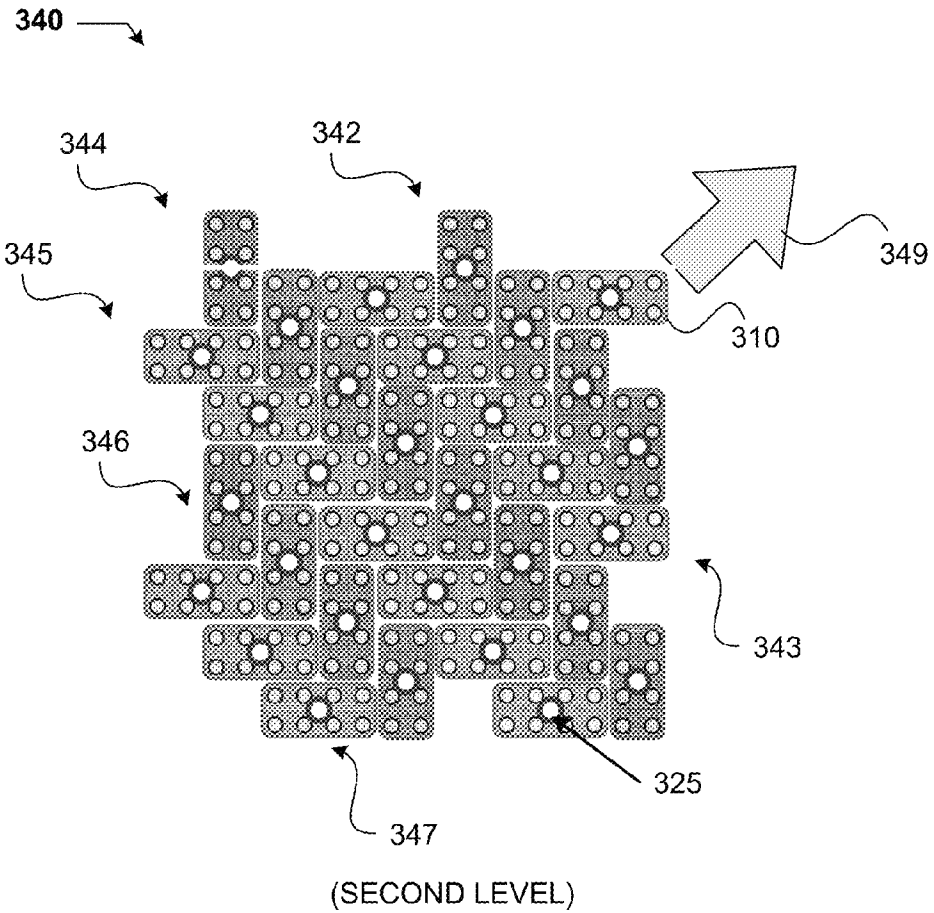
FIG. 3E is a diagram illustrating an example second-level subarray formed by interlocking the first-level subarrays of FIG. 3A, according to certain embodiments.

FIG. 3E is a diagram illustrating an example second-level subarray 340 formed by arranging the vertical or horizontal rectangular subarrays 300 and 310 of FIG. 3A, according to certain embodiments. The second-level subarray 340 may include 16 vertical rectangular subarrays 300 and 16 horizontal rectangular subarrays 310 arranged in a mosaic configuration. The mosaic configuration of the second-level subarray 340 may be formed, for example, by three diagonal sets 342, 344, and 346 of the vertical rectangular subarrays 300 and at least three diagonal sets 343, 345, and 347 of the horizontal rectangular subarrays 310. The arrangement of the diagonal sets is such that none of the diagonal sets 342, 344, and 346 (or 343, 345, and 347) are adjacent to one another. The third-level subarray 340 may also include a single subarray 310 at the top right corner.

The individual radiating elements of the second-level subarray 340 may be aligned along a rectangular lattice of the aperture. The phase centers 325 of the first-level subarrays may have a more complex symmetry relative to that of the basic rectangular lattice. The second-level subarray 340 may provide a scan in azimuth and elevation in the direction as indicated by a radiation axis 349 (e.g., along the diagonal of the aperture). Each of the subarrays of the eight-element first-level subarrays may be operable with one set of electronics for beam steering, instead of eight independent sets. This can reduce component count by eight times, while providing a directional scan in the direction of the radiation axis 349.

Figure 3G:
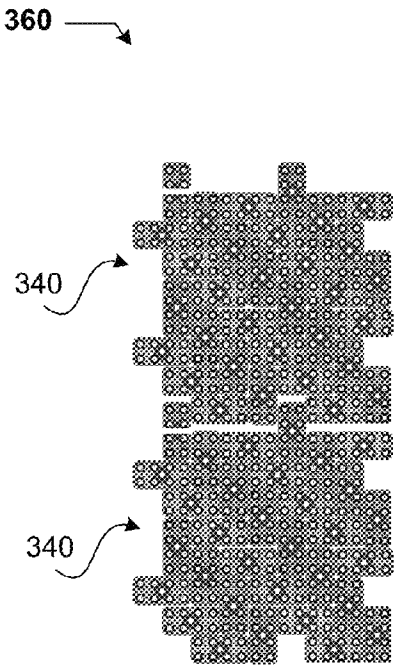
FIG. 3G is a diagram illustrating another example third-level subarray formed by interlocking the second-level subarrays of FIG. 3E, according to certain embodiments.
Figure 3F:
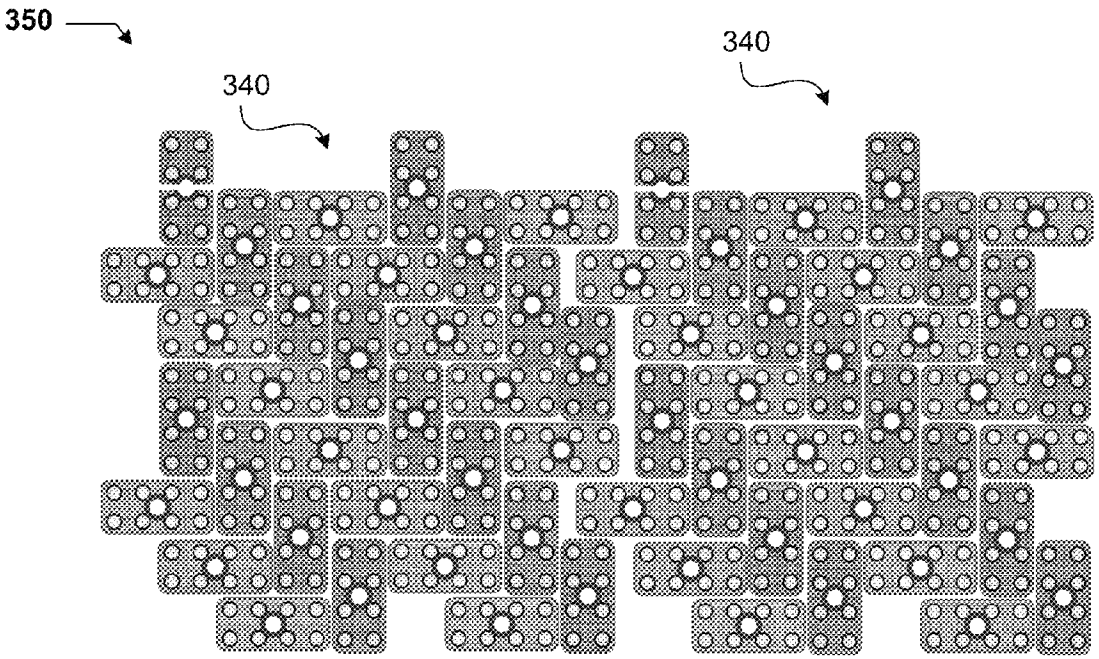
FIG. 3F is a diagram illustrating an example third-level subarray formed by interlocking the second-level subarrays of FIG. 3E, according to certain embodiments.

FIG. 3F is a diagram illustrating an example rectangular aperture antenna array (e.g., a third-level subarray) 350 formed by interlocking the second-level subarrays 340 of FIG. 3E, according to certain embodiments. The antenna array 350 may include a number of (e.g., two) second-level subarrays 340 arranged to form a horizontal rectangular aperture. The gaps between second-level subarrays 340 are shown for illustration purposes. These gaps may be minimized so that the individual radiating elements are approximately aligned to a rectangular lattice.

FIG. 3G is a diagram illustrating another example rectangular aperture antenna array (e.g., a third-level subarray) 360 formed by interlocking the second-level subarrays 340 of FIG. 3E, according to certain embodiments. The antenna array 360 may include a number of (e.g., two) second-level subarrays 340 arranged to form a vertical rectangular aperture. The gaps between second-level subarrays 340 are shown for illustration purposes. These gaps may be minimized so that the individual radiating elements are approximately aligned to a rectangular lattice.

Figure 4:
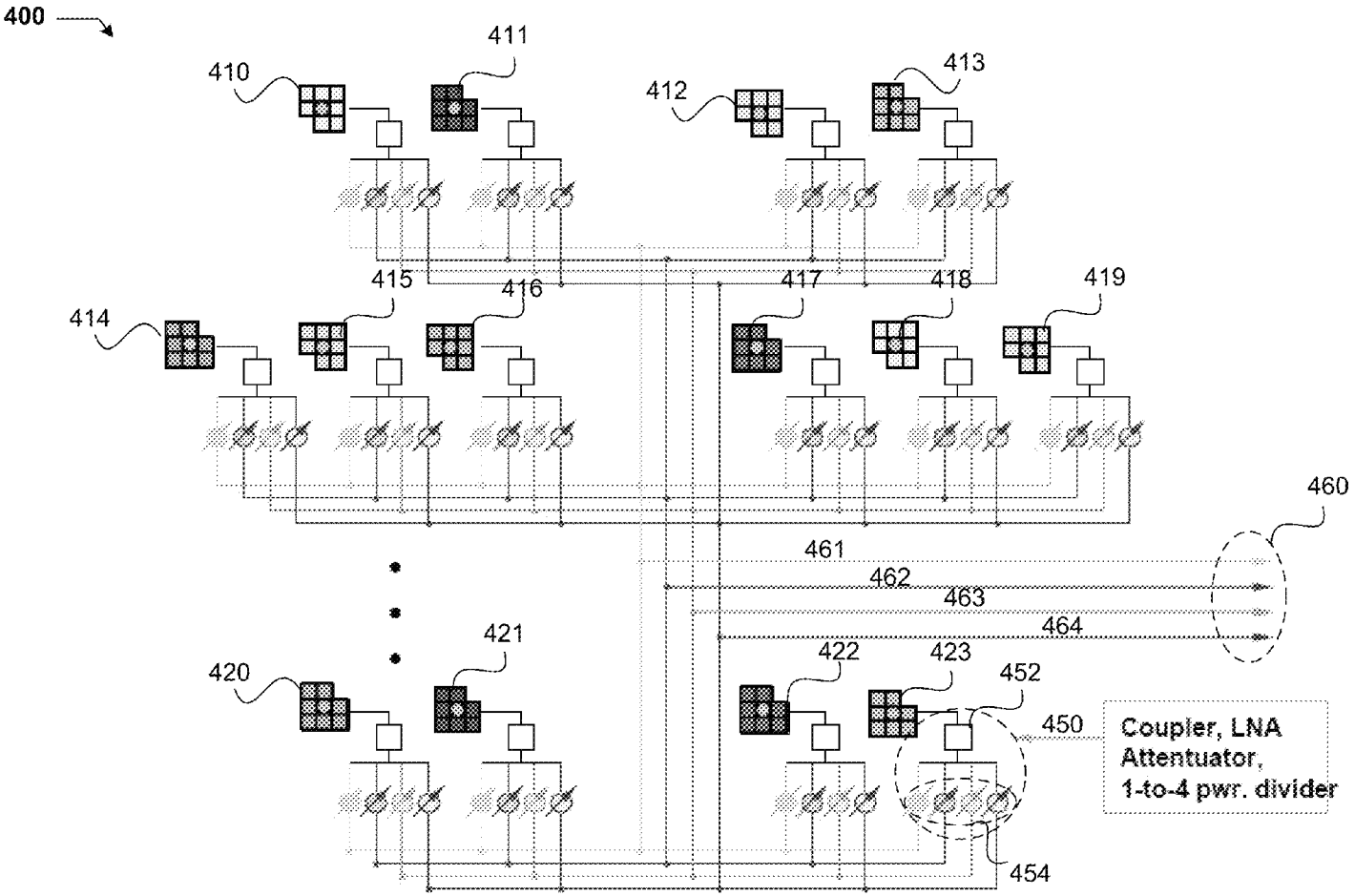
FIG. 4 is a diagram illustrating a configuration for forming a number of high quality beams using interlocked subarrays, according to certain embodiments.

FIG. 4 is a diagram illustrating a configuration 400 for forming a set 460 of high quality beams 461-464, using interlocked subarrays 410-423, according to certain embodiments. One of the advantages of the overlapping subarrays of the subject technology is to reduce the number of front-end interconnects by using a single front-end interconnect 450 for each first-level subarray (e.g., subarrays 410-423). Each front-end interconnect 450 may include one or more couplers, a single beam-steering electronic module including a low noise amplifier (LNA) and one or more attenuators, a 1-to-4 power divider 452, and a group 454 (e.g., four) of phase shifters. In the configuration 400, beams 461, 462, 463, and 464 may each be formed by combining one of the four signal paths (e.g., with the same phase shift) of each of the 1-to-4 power dividers 452 coupled to each of the first-level subarrays 410-423. For example, the beam 462 may be formed by combining the signal paths from the second signal path (from the left) of the 1-to-4 power dividers 452 coupled to each of the first-level subarrays 410-423. The signal path combined in each beam may pass through similar phase shifter (e.g., the second (from the left) phase shifter of the group 454 of phase shifters). A conventional design may include one front-end interconnect for each antenna element of a subarray (e.g., first level subarrays 410-423), which may increase the counts of the front-end interconnects by a factor of up to eight (each first-level subarray includes eight antenna elements), therefore, resulting in a substantially higher cost and weight.

Figure 5:
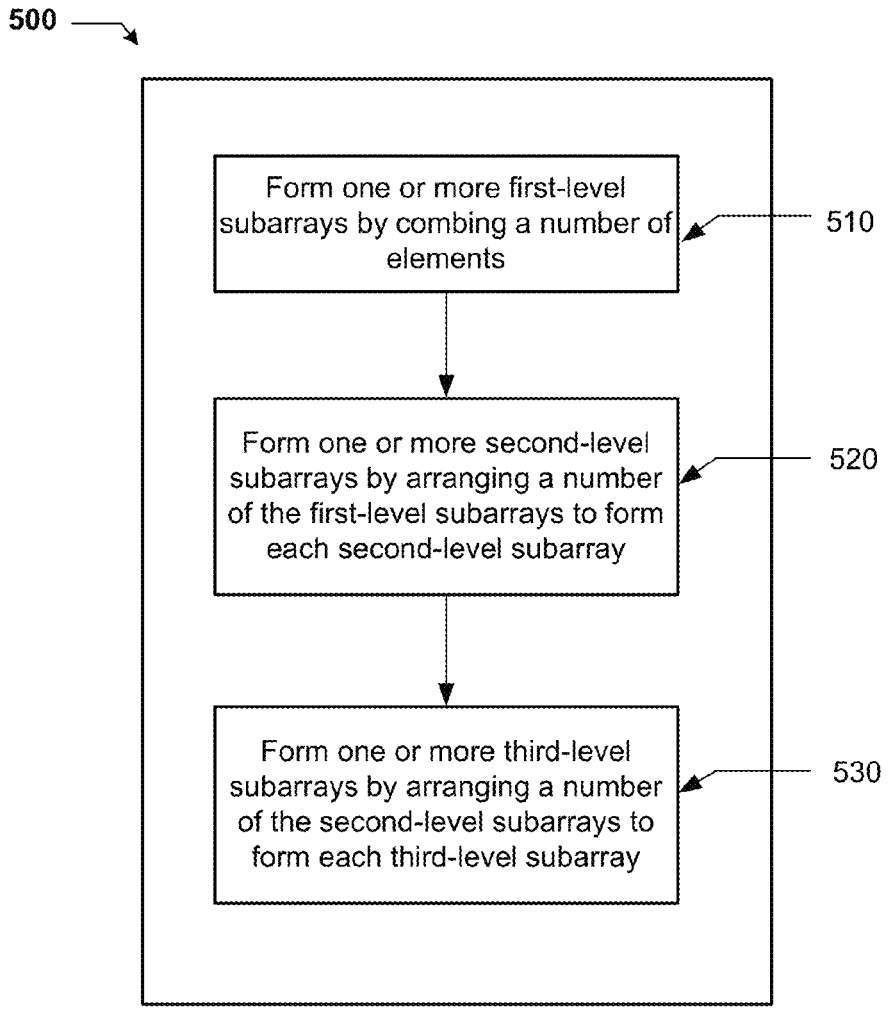
FIG. 5 is a flow diagram illustrating an example method for forming overlapping antenna subarrays, according to certain embodiments.

FIG. 5 is a flow diagram illustrating an example method 500 for forming overlapping antenna subarrays, according to certain embodiments. At operation block 510, one or more first-level subarrays (e.g., 100 and 110 of FIGS. 1A and 300 and 310 of FIG. 3A) may be formed by combing a plurality of elements (e.g., 1-8 of FIGS. 1A and 3A). Each first-level subarray may include a phase center (e.g., element 4 of first-level subarray 100 and element 5 of first-level subarray 110 of FIG. 1A).

At operation block 520, one or more second-level subarrays may be formed by arranging a plurality of the first-level subarrays to form each second-level subarray (e.g., 120 of FIG. 1B, 200 of FIG. 2A, and 322 and 324 of FIG. 3B) may be formed by interlocking the first-level subarrays. At operation block 530, one or more third-level subarrays (e.g., 130 of FIG. 1C, 210 of FIG. 2B, and 320 of FIG. 3B) may be formed by arranging multiple second-level subarrays to form each third-level subarray. The first-level, second-level, and third-level subarrays may include interlocking features that allow interlocking of each subarray with another one of the same subarray.

The description of the subject technology is provided to enable any person skilled in the art to practice the various embodiments described herein. While the subject technology has been particularly described with reference to the various figures and embodiments, it should be understood that these are for illustration purposes only and should not be taken as limiting the scope of the subject technology.

In some aspects, the subject technology is related to phased array antennas. In some aspects, the subject technology may be used in various markets, including for example and without limitation, data transmission and communications, radar, and active phased arrays.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various embodiments described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed embodiments, one having ordinary skill in the art will readily appreciate that these embodiments are only illustrative of the invention. It should be understood that various modifications can be made without departing from the spirit of the invention. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. A method of forming overlapping antenna subarrays, comprising:

forming one or more first-level subarrays by combing a plurality of elements, each first-level subarray having a phase center; and forming one or more second-level subarrays by arranging a plurality of the first-level subarrays to form each second-level subarray, wherein:

a) the first-level and second-level subarrays comprise overlapping antenna subarrays, b) each of the plurality of elements comprises an antenna element, c) at least some of the first level or second-level subarrays include an interlocking feature that allows interlocking of each subarray with another one of the same subarray, d) arranging comprises interlocking, and e) the phase center of the first-level subarray comprises an electrical center, and is controlled to be positioned near a center of the first-level subarray.

2. The method of claim 1, further comprising:

forming one or more third-level subarrays by arranging a plurality of the second-level subarrays to form each third-level subarray; and providing a single beam-steering electronic module for each first-level subarray, wherein:

a) each of the plurality of elements further comprises at least one of an ultrasonic sensor or an audio transducer, and b) the third-level subarrays comprise overlapping antenna subarrays and the interlocking feature.

3. The method of claim 2, wherein the third-level subarray has the interlocking feature, and further comprising forming an antenna array by interlocking a plurality of the third-level subarrays.

4. The method of claim 2, further comprising forming the first-level subarray by placing eight elements in eight cells of a nine-cell square, and providing the interlocking feature by leaving a corner cell of the nine-cell square empty.

5. The method of claim 4, further comprising:

forming a first and a second type of the first-level subarray, wherein the empty corner cells of first type and the second type first-level subarrays are located on opposite sides of a symmetry axis of the first-level subarray; and forming the second-level subarray by:

forming a linear subarray by interlocking, along a first axis, a first set of the first type first-level subarrays; and interlocking a second set of the second type first-level subarrays on each side of the linear subarray and on a second axis parallel to the first axis;

wherein, a count of the first type first-level subarrays in the first set is four, and a count of the second type first-level subarrays in the second set is three, and wherein the first axis comprises a radiation axis of the second-level subarray.

6. The method of claim 5, wherein forming the third-level subarray comprises forming a rectangular subarray, and wherein the radiation axes of the interlocked second-level subarrays are parallel to a diagonal of the rectangular subarray.

7. The method of claim 5, wherein forming the third-level subarray comprises forming a square subarray by interlocking a plurality of first type and second type first-level subarrays, wherein an effective overlapping between the subarrays is the highest along a diagonal of the square subarray, and wherein the radiation axis of third-level subarray is aligned with the diagonal of the square subarray.

8. The method of claim 7, further comprising forming an antenna array by:

interlocking eight square subarrays wherein the square subarrays are interlocked similar to elements of at least one of the first type or the second type first-level subarray, or interlocking 32 square subarrays wherein the square subarray are interlocked to fill cells of a 36-cell square array, excluding the corner cells.

9. The method of claim 4, wherein:

a) forming the second-level subarray comprises interlocking two of the first-level subarrays, and b) forming the third-level subarray comprises interlocking four of the second-level subarrays, and c) the method further comprises:

forming a fourth-level subarray by interlocking four of the third-level subarrays; and forming an antenna array by interlocking two of the fourth-level subarrays, d) the antenna array has an approximately rectangular aperture.

10. The method of claim 2, wherein:

a) forming the first-level subarray comprises forming at least one of a horizontal or vertical rectangular subarray, each of the horizontal or vertical rectangular subarrays including eight elements arranged in a two-by-four configuration, b) forming the second-level subarray comprises at least one of:

vertically stacking two horizontal rectangular subarrays to form a horizontal square subarray, or positioning two vertical rectangular subarrays side-by-side to form a vertical square subarray;

c) forming the third-level subarray comprises arranging eight horizontal square subarrays and eight vertical square subarray in a four-by-four square configuration, wherein no horizontal square subarray is adjacent to a vertical square subarray, and further comprising:

d) the method further comprises forming an antenna array by arranging 32 third-level subarrays to fill cells of a 36-cell square array, excluding the corner cells.

11. The method of claim 10, wherein:

a) forming the third-level subarray comprises arranging 16 horizontal rectangular subarrays and 16 vertical rectangular subarrays in a mosaic configuration, wherein the mosaic configuration comprise three diagonal sets of vertical rectangular subarrays and at least three sets of horizontal rectangular subarrays, and wherein no diagonal set of vertical rectangular subarrays is adjacent to another diagonal set of vertical rectangular subarrays, and b) forming the antenna array comprises interlocking a plurality of the third-level subarrays.

12. An apparatus comprising:

one or more first-level subarrays, each having a phase center and including a plurality of elements; and one or more second-level subarrays, each formed by arranging a plurality of the first-level subarrays to form each second-level subarray, wherein:

a) the first-level and second-level subarrays comprise overlapping antenna subarrays, b) each of the plurality of elements comprises an antenna element, c) at least some of the first level or second-level subarrays include interlocking features configured to allow interlocking of each subarray with another one of the same subarray, d) arranging comprises interlocking, and e) the phase center of the first-level subarray comprises an electrical center, and is controlled to be positioned near a center of the first-level subarray.

13. The apparatus of claim 12, further comprising:

one or more third-level subarrays formed by arranging a plurality of the second-level subarrays; and a single beam-steering electronic module for each first-level subarray; and an antenna array formed by interlocking a plurality of the third-level subarrays and configured to radiate with a radiation pattern, wherein:

a) each of the plurality of elements further comprises at least one of an ultrasonic sensor or an audio transducer, b) the third-level subarrays comprise overlapping antenna subarrays, and c) the third-level subarray is configured to have the interlocking feature, and an antenna array is formed by interlocking a plurality of the third-level subarrays.

14. The apparatus of claim 13, wherein the first-level subarray is formed by placing eight elements in eight cells of a nine-cell square that is configured to provide the interlocking feature by having a corner cell of the nine-cell square empty.

15. The apparatus of claim 14, further comprising:

a first and a second type of the first-level subarray having the respective empty corner cells on opposite sides of a symmetry axis of the first-level subarray; and the second-level subarray comprises:

a linear subarray formed by interlocking, along a first axis, a first set of the first type first-level subarrays; and a second set of the second type first-level subarrays interlocked on each side of the linear subarray and on a second axis parallel to the first axis;

wherein, a count of the first type first-level subarrays in the first set is four, and a count of the second type first-level subarrays in the second set is three, and wherein the first axis comprises a radiation axis of the second-level subarray.

16. The apparatus of claim 15, wherein the third-level subarray comprises a rectangular subarray, and wherein the radiation axes of the interlocked second-level subarrays are parallel to a diagonal of the rectangular subarray.

17. The apparatus of claim 15, wherein:

a) the third-level subarray comprises a square subarray formed by interlocking a plurality of the first type and the second type first-level subarrays, b) an effective overlapping between the subarrays is the highest along a diagonal of the square subarray, and c) the radiation axis of the third-level subarray is aligned with the diagonal of the square subarray; and d) the apparatus further comprises an antenna array including:

eight square subarrays interlocked similar to elements of at least one of the first type or the second type first-level array, or 32 square subarrays interlocked to fill cells of a 36-cell square array, excluding the corner cells.

18. The apparatus of claim 14, wherein:

a) the second-level subarray comprises two of the first-level subarrays interlocked with each other, and b) the third-level subarray comprises four of the second-level subarrays, and the apparatus further comprises:

a fourth-level subarray formed by interlocking four of the third-level subarrays; and an antenna array formed by interlocking two of the fourth-level subarrays, wherein the antenna array has an approximately rectangular aperture.

19. The apparatus of claim 13, wherein:

a) the first-level subarray comprises at least one of a horizontal or vertical rectangular subarray, each of the horizontal or vertical rectangular subarrays including eight elements arranged in a two-by-four configuration, b) the second-level subarray comprises at least one of:

two horizontal rectangular subarrays vertically stacked to form a horizontal square subarray, or two vertical rectangular subarrays positioned side-by-side to form a vertical square subarray, c) the third-level subarray comprises eight horizontal square subarrays and eight vertical square subarray arranged in a four-by-four square configuration, wherein no horizontal square subarray is adjacent to a vertical square subarray, d) the apparatus further comprising an antenna array formed by arranging 32 third-level subarrays to fill cells of a 36-cell square array, excluding the corner cells, e) the third-level subarray comprises 16 horizontal rectangular subarrays and 16 vertical rectangular subarrays arranged in a mosaic configuration, wherein the mosaic configuration comprise three diagonal sets of vertical rectangular subarrays and at least three horizontal rectangular subarrays, and wherein no diagonal set of vertical rectangular subarrays is adjacent to another diagonal set of vertical rectangular subarrays, and wherein the antenna array comprises a plurality of the third-level subarrays.

20. An antenna array comprising:

one or more first-level subarrays, each first-level subarray including a plurality of antenna elements, having a phase center, and configured to function with a single beam-steering electronic module; and one or more second-level subarrays, each formed by arranging a plurality of the first-level subarrays to form each second-level subarray, wherein:

a) the first-level and second-level subarrays comprise overlapping antenna subarrays having interlocking features configured to allow interlocking of each subarray with another one of the same subarray, b) arranging comprises interlocking, and c) the antenna array is formed by interlocking a plurality of the second-level subarrays and configured to radiate with a radiation pattern, and e) the phase center of the first-level subarray comprises an electrical center, and is controlled to be positioned near a center of the first-level subarray.

* * * * *